US008973169B2

(12) United States Patent
Curtis et al.

(10) Patent No.: US 8,973,169 B2
(45) Date of Patent: Mar. 10, 2015

(54) PROTECTIVE GARMENT WITH MODULAR STORAGE SYSTEM

(71) Applicant: Lion Apparel, Inc., Dayton, OH (US)

(72) Inventors: Nicholas J. Curtis, Liberty Township, OH (US); Margaret Diane Best, Beattyville, KY (US)

(73) Assignee: Lion Apparel, Inc., Dayton, OH (US)

( * ) Notice: Subject to any disclaimer, the term of this patent is extended or adjusted under 35 U.S.C. 154(b) by 6 days.

(21) Appl. No.: 13/767,941

(22) Filed: Feb. 15, 2013

(65) Prior Publication Data

US 2013/0212788 A1 Aug. 22, 2013

Related U.S. Application Data

(60) Provisional application No. 61/600,343, filed on Feb. 17, 2012.

(51) Int. Cl.

| | |
|---|---|
| ***A41D 27/20*** | (2006.01) |
| ***A62B 17/00*** | (2006.01) |
| ***A41D 13/00*** | (2006.01) |
| *A41D 27/00* | (2006.01) |
| *A41D 31/00* | (2006.01) |

(52) U.S. Cl.

CPC ..... *A62B 17/003* (2013.01); *A41D 13/0012* (2013.01); *A41D 31/0022* (2013.01)

USPC ..... 2/251; 2/247; 2/249

(58) Field of Classification Search

CPC ..... A41D 13/0012; A41D 27/20; A41D 3/02; A41D 13/00; A41D 13/0005; A41D 2400/70; A41D 13/1209; A41D 1/04; A41D 27/08; A41D 31/0022; A41D 31/0027; A45F 5/02; A45F 3/14; A45F 2003/001; A45F 2003/146; A45F 3/04; A45F 2005/023; A45F 3/06; A62B 17/003; A62B 17/001; A62B 17/006; F41H 1/02; A41F 5/00; A45C 13/30; A45C 13/40; A45C 5/06; Y10S 2/92

See application file for complete search history.

(56) References Cited

U.S. PATENT DOCUMENTS

| | | | | | |
|---|---|---|---|---|---|
| 4,106,121 | A | * | 8/1978 | Belson | 2/102 |
| 4,249,268 | A | * | 2/1981 | Berler | 2/115 |
| 4,303,187 | A | * | 12/1981 | Berman | 224/222 |
| 5,054,127 | A | * | 10/1991 | Zevchak | 2/247 |
| 5,568,889 | A | * | 10/1996 | Holloway et al. | 224/661 |
| 5,724,707 | A | * | 3/1998 | Kirk et al. | 24/3.7 |
| 5,991,925 | A | * | 11/1999 | Wu | 2/102 |

(Continued)

OTHER PUBLICATIONS

International Search Report and Written Opinion, PCT/US2013/026258 (May 6, 2013).

(Continued)

*Primary Examiner* — Bobby Muromoto, Jr.

(74) *Attorney, Agent, or Firm* — Thompson Hine LLP

(57) ABSTRACT

Protective garments having a modular storage system that enables the wearer to move and customize the position of pockets and other storage features, and hence the location of tools and other apparatus or accessories. The protective garment, including the modular storage system, are fire resistant such that they are in compliance with National Fire Protection Association and European Norm standards for firefighting garments set by the European Committee for Standardization, which is also known as Comité Européen de Normalisation, and may be integral with the protective garment.

21 Claims, 7 Drawing Sheets

(56) References Cited

U.S. PATENT DOCUMENTS

| | | | | |
|---|---|---|---|---|
| 6,279,804 | B1 * | 8/2001 | Gregg | 224/675 |
| D516,777 | S * | 3/2006 | Beck | D2/829 |
| 7,080,430 | B2 * | 7/2006 | Wemmer | 24/578.13 |
| 7,090,102 | B1 * | 8/2006 | Lipke | 224/250 |
| 7,200,871 | B1 * | 4/2007 | Carlson | 2/103 |
| 7,963,427 | B2 * | 6/2011 | Calkin | 224/675 |
| 8,032,951 | B1 * | 10/2011 | Nestberg et al. | 2/247 |
| 2005/0076422 | A1 * | 4/2005 | Aldridge et al. | 2/455 |
| 2005/0188450 | A1 * | 9/2005 | Clark | 2/247 |
| 2006/0113344 | A1 * | 6/2006 | Cragg | 224/579 |
| 2007/0079416 | A1 * | 4/2007 | Carlson | 2/2.5 |
| 2009/0031467 | A1 * | 2/2009 | Swindells et al. | 2/51 |
| 2009/0255029 | A1 * | 10/2009 | Aldridge | 2/81 |
| 2009/0255039 | A1 * | 10/2009 | Danielsson | 2/458 |
| 2009/0320176 | A1 * | 12/2009 | Curtis | 2/81 |
| 2011/0114684 | A1 * | 5/2011 | Ya'akobovich et al. | 224/259 |
| 2013/0212788 | A1 * | 8/2013 | Curtis et al. | 2/455 |

OTHER PUBLICATIONS

Website featuring "MOLLE Pouch Attachment Ladder System (PALS)" by Olive-Drab, http://olive-drab.com/od_soldiers_gear_molle_pals.php (first retrieved from the internet at least prior to Jan. 4, 2012).

On-line catalog featuring "Molle Vest Combo—MOLLE Plus—Galati Gear" by Galati International (Nov. 2011).

On-line catalog featuring "Bt 08 Paintball Thigh Rig Molle Woodland Digital Camo," www.opsgear.com/MOLLE_Tactical_Gear (first retrieved from the internet at least prior to Jan. 4, 2012).

On-line catalog featuring "New Molle Versatile Thigh Holster Desert Tan—Airsoft," www.ebay.com (first retrieved from the internet at least prior to Jan. 4, 2012).

Website featuring "new Technologies" by FirstSpear, LLC., http://www.first-spear.com/pages.php?pageid=20 (first retrieved from the internet on Nov. 19, 2013).

* cited by examiner

PROTECTIVE GARMENT WITH MODULAR STORAGE SYSTEM

RELATED APPLICATIONS

This application claims the benefit of U.S. Provisional Application No. 61/600,343, filed Feb. 17, 2012.

TECHNICAL FIELD

The present invention relates to protective garments, and more particularly, to protective garments that include modular storage systems such as firefighter garments.

BACKGROUND

Protective or hazardous duty garments are widely used in various industries to protect the wearer from various hazardous conditions such as heat, smoke, cold, sharp objects, chemicals, liquids, fumes and the like. Protective or hazardous duty garments primarily rely upon permanently attached pockets for storage capacity. The wearer of such garments, however, uses a wide variety of tools, communication devices, work gloves, goggles, ropes, and rescue lines, for example, that have very different shapes and sizes. Current designs are not equipped to provide the wearer with the ability to move and customize the pockets or other storage features.

SUMMARY

In one aspect, protective garments are disclosed herein that have a modular storage system that enables the wearer to move and customize the position of pockets and other storage features, and hence the location of tools and other necessary apparatus for performing their duties. In one embodiment, the protective garments, including the modular storage system, are fire resistant and comply with National Fire Protection Association ("NFPA") and European Norm standards for firefighting garments set by the European Committee for Standardization (also known as Comité Européen de Normalisation). In one embodiment, the modular storage system is integral with the protective garment (i.e., it is not a separable vest, belt, rucksack, etc.). In another embodiment, the fire resistant modular storage system is separate from the protective garment and is attachable to the wearer, for example, by a connection to a belt of the wearer.

In another aspect, the modular storage system is a protective garment having a portion of material that includes a flame resistant or chembio resistant material and a field of slits therein or thereon. The field of slits contains a plurality of horizontally-oriented rows each having one or more slits that are aligned with adjacent slits in adjacent horizontally-oriented rows to create one or more columns each generally aligned with or centered on different parasagittal planes when worn by a wearer. The modular storage system also includes a removable accessory having an exterior back surface and at least one strap having a first end fixed to the accessory and a second end that is a free end. The exterior back surface includes a first portion of a releasably attachable fastening system and the strap includes a second portion of the releasably attachable fastening system on the side of the strap that faces the exterior back surface in an assembled state. When assembled, the free end of the strap has passed through at least two adjacent slits and the second portion of the releasably attachable fastening system is positioned on the strap such that it is on an exposed portion thereof protruding from the second of the two adjacent slits and the releasably attachable fastening system on the exterior back surface is mated to the exposed portion of the strap.

In one embodiment, the slits are cut into a portion of material, which is coated on one or both major surfaces with a polymer that prevents fraying or unraveling of the material after formation of the slits therein. The portion of material may be integral with the outer surface of the garment or fixed thereto. The polymer includes natural or synthetic rubber such as a chlorosulfonated polyethylene synthetic rubber or a natural or synthetic butyl rubber.

In another aspect, methods are disclosed for making the modular storage system. The methods include providing a portion of material comprising a fire resistant or chembio resistant material, coating the portion of material with a polymer that prevents fraying or unraveling of the material, and cutting a field of slits in the portion of material.

In another embodiment, the field of slits may include a plurality of spaced apart fire resistant strips that are each permanently fixed to a portion of an outer surface of the protective garment at spaced apart locations along each strip such that the spacing between locations is of sufficient distance to define openings capable of receiving straps therethrough.

In another aspect, the modular storage system is releasably attachable to a protective garment and is fire resistant. The modular storage system has one of the constructions described above except that a panel is releasably attachable to the wearer, for instance, over the outer surface of a protective garment. The panel may include a first connector capable of attaching the panel to a belt of a wearer and a second connector capable of attaching the panel to the leg of the wearer. The first connector may include an adjuster to change the length of the first connector between the belt of the wearer and the top of the panel.

DETAILED DESCRIPTION

Figure 1A:
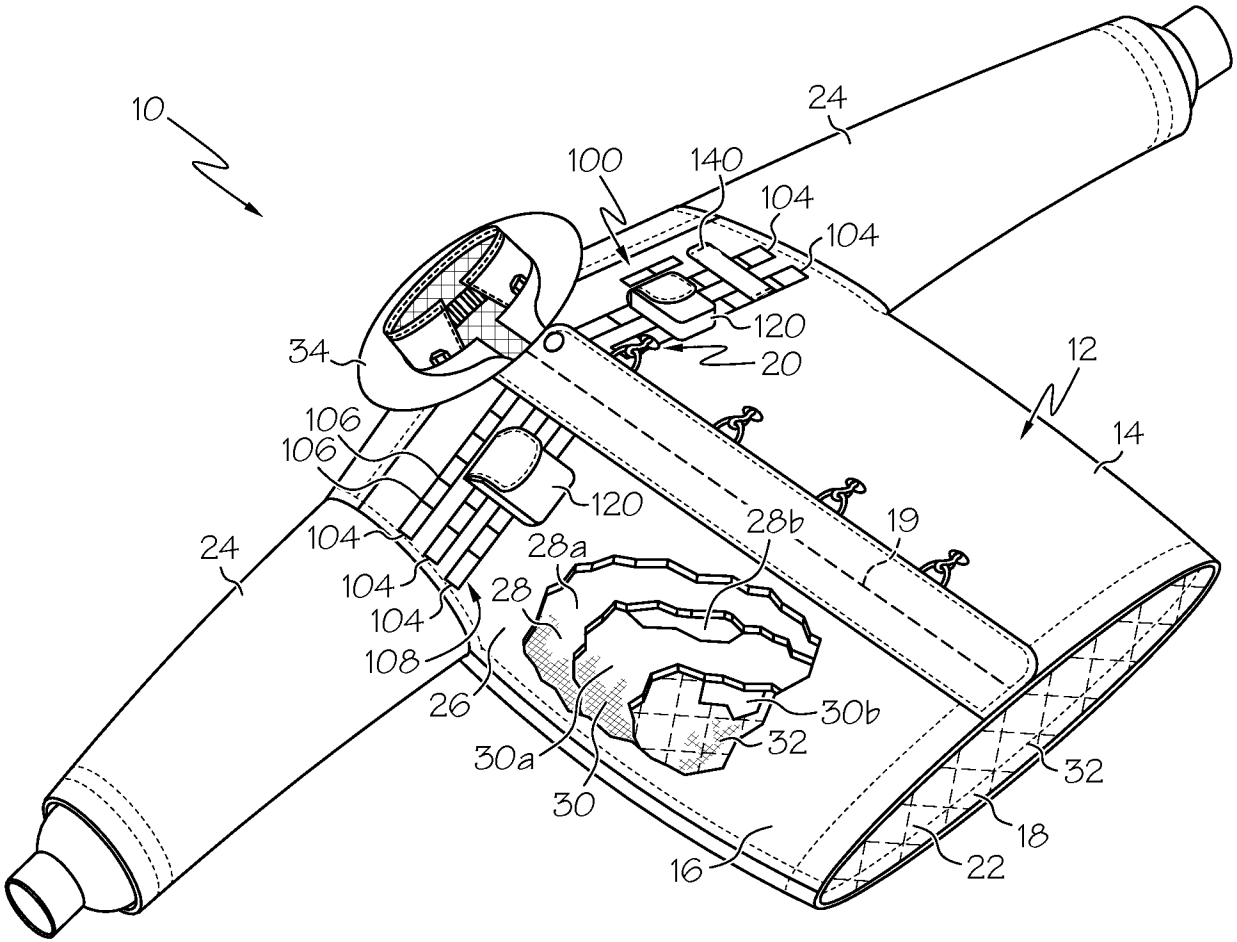
FIGS. 1A and 1B are front perspective views of firefighter coats having alternate embodiments of modular storage systems, with portions of various layers of the coats cut away for illustrative purposes.

The following detailed description will illustrate the general principles of the invention, examples of which are additionally illustrated in the accompanying drawings. In the drawings, like reference numbers indicate identical or functionally similar elements.

Figure 4:
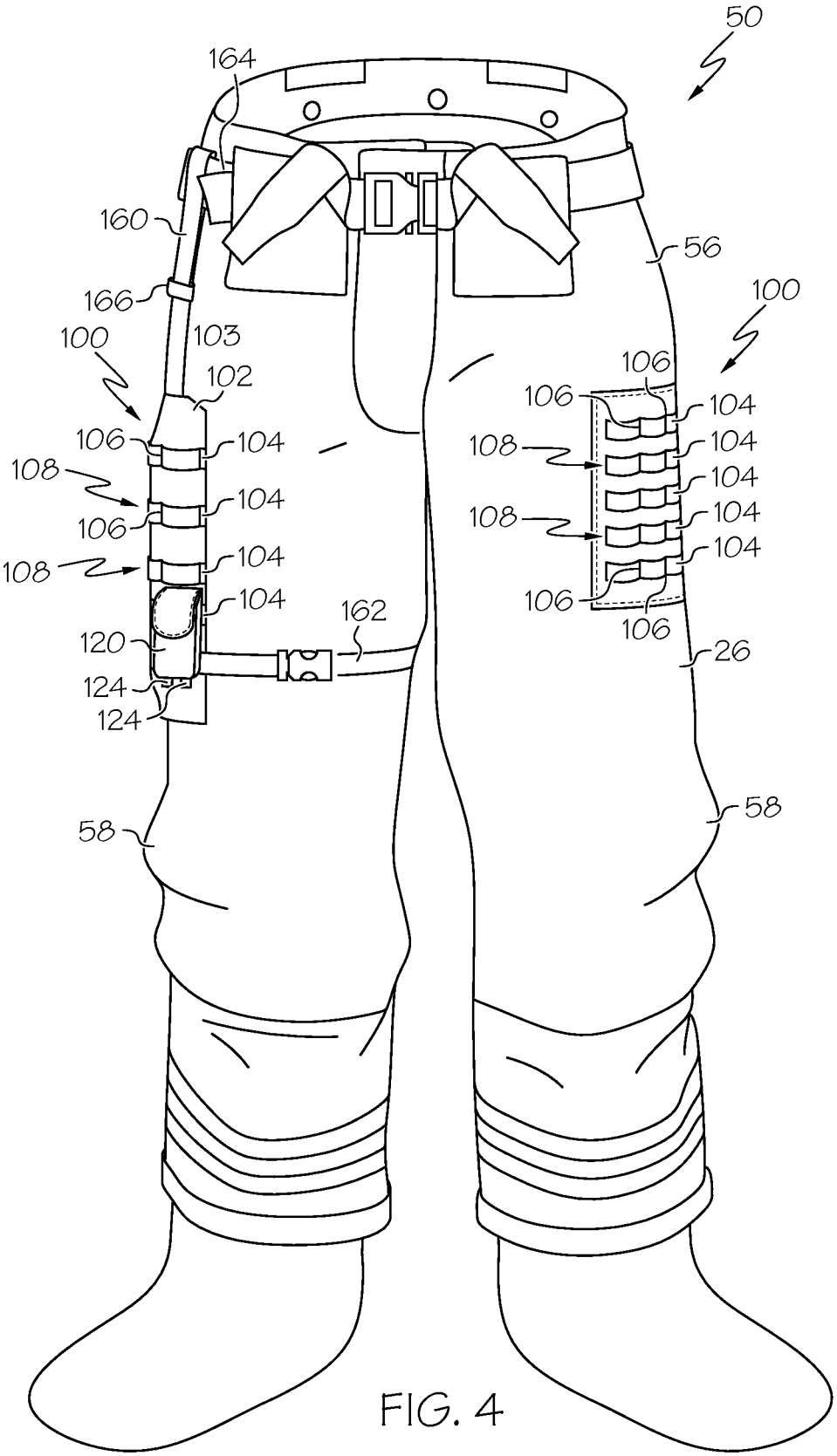
FIG. 4 is a front view of firefighter trousers having both an integral modular storage system and a removable modular storage system.

A protective or hazardous duty garment in the form of a firefighter's coat, generally designated 10, and firefighter's trouser, generally designated 50, are illustrated respectively in FIGS. 1 and 4. The illustrated embodiments are chosen merely as examples. The protective or hazardous duty garment may take other forms including, but not limited to, jackets, vests, and one-piece suits. The protective garments may also be CBRN (chemical, biological, radiological, and nuclear) protective ensembles, EMS (emergency medical services) garments, tactical rescue and/or urban search and rescue ensembles. The coat 10 and trousers 50 each include a modular storage system 100. When the protective garments are firefighter garments, the modular storage system 100 as well as the garment itself should be made with fire resistant material such that the garment meets NFPA 1951, 1971, 1977, 1991, 1992, and/or 1993 standards for protective firefighting garments and/or the European Norm standards for firefighting garments. The modular storage system 100 will be described in detail below after the discussion of the general construction of the garments themselves.

Figure 1B:
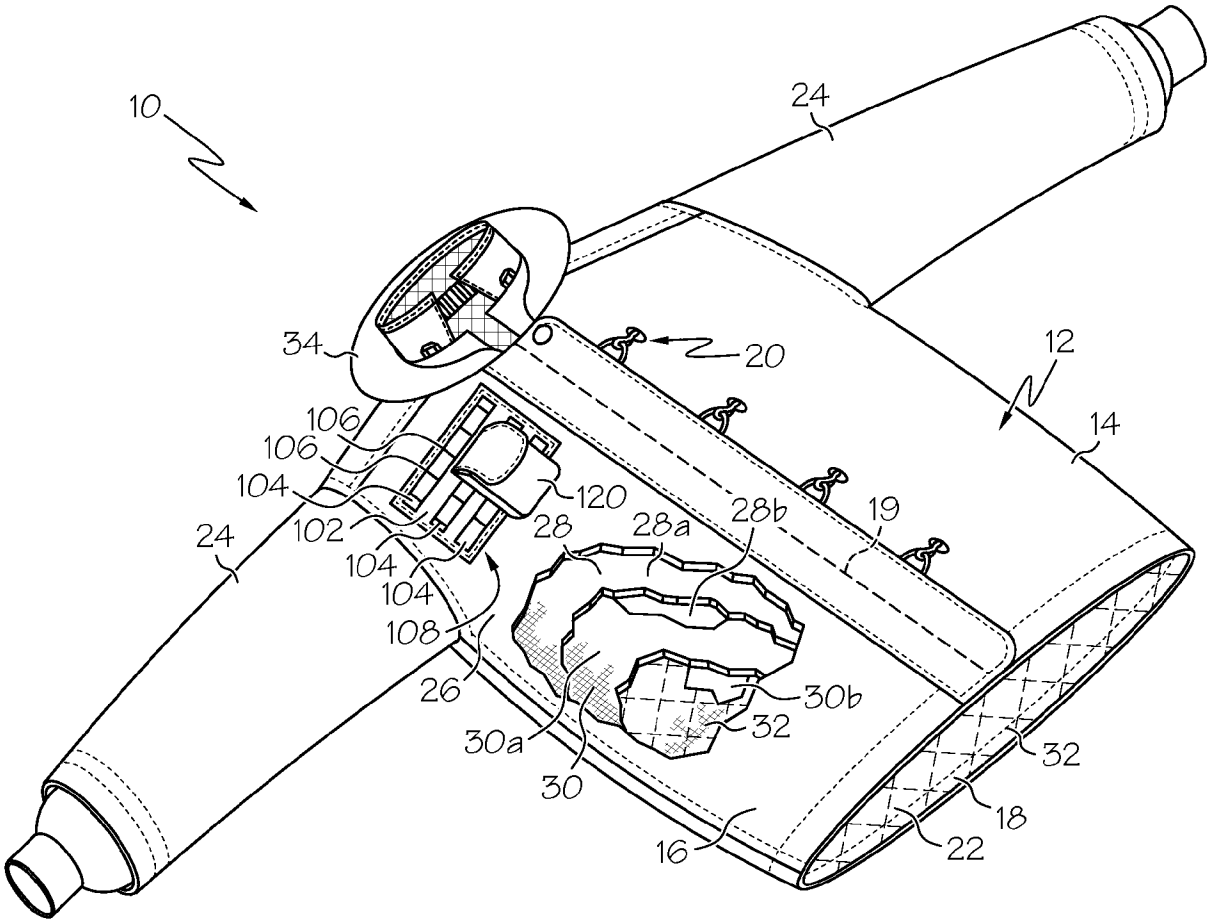

Referring to FIGS. 1A and 1B, the coat 10 may include a body portion 12 having a left front panel 14, right front panel 16 and a back panel 18. The left front panel 14 and right front panel 16 may be releasably attachable by a fastener 20, such as a zipper, snaps, clasps, clips, hook-and-loop fastening material (i.e., VELCRO® fastening material), and combinations of these components or the like. The body portion 12 may define a torso cavity 22 that is shaped and configured to receive a wearer's torso therein. The garment 10 may include a pair of sleeves 24 coupled to and extending generally outwardly from the body portion 12 and shaped to receive a wearer's arms therein. The modular storage system 100 may be permanently fixed directly to the outer surface of the coat 10 as shown in FIG. 1A or permanently fixed to a panel of material 102 that is separately attached to the outer surface of the coat 10 as shown in FIG. 1B. The modular storage system 100 is illustrated as positioned on the body portion 12 on the upper chest portion near the shoulders of the coat, but may be positioned in any desirable location. The upper chest area may be preferred because the straps of a SCBA (self-contained breathing apparatus) typically do not cover or block access to this area of the coat 10.

Referring to FIG. 4, the trousers 50 include a body portion/upper leg portion 56 configured to receive the lower part of the torso and the upper part of the legs of a wearer and a pair of extremities or lower leg portions 58 configured to receive the lower part of the leg of a wearer. The modular storage system 100 may be permanently fixed directly to the outer surface of the trousers 50 as shown on the left leg in FIG. 4 or permanently fixed to a panel of material 102 that is separately attached to the outer surface of the trouser 50 as shown on the right leg in FIG. 4. The modular storage system 100 is illustrated as positioned generally on the outer thigh of the trousers, but may be positioned in any desirable location that is accessible to the hands of the wearer.

The coat 10 and trousers 50 may include various layers through their thicknesses to provide various heat, moisture and abrasion resistant qualities to the garments so that the garments can be used as a protective, hazardous duty, and/or firefighter garment. For example, as illustrated in FIGS. 1A and 1B, the garment may include an outer shell 26, a moisture barrier 28 located inside of and adjacent to the outer shell 26, a thermal liner or barrier 30 located inside of and adjacent to the moisture barrier 28, and an inner liner or face cloth 32 located inside of and adjacent to the thermal barrier 30.

The outer shell 26 may be made of or include a variety of materials, including a flame, heat and abrasion resistant material such as a compact weave of aramid fibers and/or polybenzamidazole fibers. Commercially available aramid materials include NOMEX® and KEVLAR® fibers (both trademarks of E.I. DuPont de Nemours & Co., Inc. of Wilmington, Del.), and commercially available polybenzamidazole fibers include PBI fibers (a trademark of PBI Performance Fabrics of Charlotte, N.C.). Thus, the outer shell 26 may be an aramid material, a blend of aramid materials, a polybenzamidazole material, a blend of aramid and polybenzamidazole materials, or other appropriate materials. The outer shell 26 can also be made of a thermostable organic polymer material, such as KERMEL® material sold by Kermel SAS of Colmar, France.

The outer shell 26 may also include other flame resistant material alone or in combination with those materials listed above or with those materials in the following list: flame resistant polynesic rayon, flame resistant cotton, flame resistant polyester, polyvinyl alcohol, polytetrafluoroethylene, flame resistant wool, polyvinyl chloride, polyether ether ketone, polyetherimide, polyethersulfone, polychal, polyimide, aliphatic polyamide, polyimide-amide, flame resistant polyolefin, polybenzoxazole, flame resistant acetone, carbon, modocrylic, melamine, and glass.

If desired, the outer shell 26 may be coated with a polymer, such as a durable, water repellent finish (i.e. a perfluorohydrocarbon finish, such as TEFLON® finish sold by E. I. Du Pont de Nemours and Company of Wilmington, Del.). The materials of the outer shell 26 may have a weight of, for example, between about five and about ten oz/yd$^2$.

The moisture barrier 28 and thermal barrier 30 may be generally coextensive with the outer shell 26, or spaced slightly inwardly from the outer edges of the outer shell 26 (i.e., spaced slightly inwardly from the outer ends of the sleeves 24, the collar 34 and from the lower edge of the garment) to provide moisture and thermal protection throughout the garment. The moisture barrier 28 may include a semi-permeable membrane layer 28*a* and a substrate 28*b*.

The membrane layer 28*a* may be generally water vapor permeable but generally impermeable to liquid moisture. The membrane layer 28*a* may be made of or include expanded polytetrafluoroethylene ("PTFE") such as GORE-TEX® or CROSSTECH™ materials (both of which are trademarks of W.L. Gore & Associates, Inc. of Newark, Del.), polyurethane-based materials, neoprenebased materials, cross-linked polymers, polyamide, or other materials. The membrane layer 28*a* may have microscopic openings that permit moisture vapor (such as water vapor) to pass therethrough, but block liquids (such as liquid water) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28*a* may also be a combination of microporous and monolithic materials (known as a bicomponent moisture barrier), in which the microporous or monolithic materials are layered or intertwined.

The membrane layer 28*a* may be bonded or adhered to a substrate 28*b* of a flame and heat resistant material to provide structure and protection to the membrane layer 28*a*. The substrate 28*b* may be or include aramid fibers similar to the aramid fibers of the outer shell 26, but may be thinner and lighter in weight. The substrate 28*b* may be woven, nonwoven, spunlace or other materials. In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*.

The thermal barrier 30 may be made of nearly any suitable flame resistant material that provides sufficient thermal insulation. In one embodiment, the thermal barrier 30 may include a layer of bulk material 30*a* in the form of relatively thick (i.e. between about 1/16"-3/16") batting, felt or needled non-woven bulk or batting material. The bulk material 30*a* can include aramid fiber batting (such as NOMEX® batting), aramid needlepunch material, an aramid non-woven material, an aramid blend needlepunch material, an aramid blend batting material, an aramid blend non-woven material, foam (either open cell or closed cell), or other suitably thermally insulating materials. The bulk material 30*a* may trap air and possess sufficient loft to provide thermal resistance to the garment.

The bulk material 30*a* may be quilted to a thermal barrier face cloth 30*b* which can be a weave of a lightweight aramid material. Thus, either the bulk material 30*a* alone, or the bulk material 30*a* in combination with the thermal barrier face cloth 30*b*, may be considered to constitute the thermal barrier 30. In the illustrated embodiment, the thermal barrier bulk material 30*a* is located between the outer shell 26 and the thermal barrier face cloth 30*b*. However, the orientation of the thermal barrier 30 may be reversed such that the face cloth 30*b* is located between the outer shell 26 and the bulk layer 30*a*. In one embodiment, the thermal barrier 30 (or the garment as a whole) may have a thermal protection performance ("TPP") of at least about twenty, and the garment as a whole may have a TPP of at least about thirty-five. If desired, the thermal barrier 30 may be treated with a water-resistant or water-repellent finish.

Although the moisture barrier 28 is shown as being located between the outer shell 26 and the thermal barrier 30, the positions of the moisture barrier 28 and thermal barrier 30 may be reversed such that the thermal barrier 30 is located between the outer shell 26 and the moisture barrier 28, or various other orientations or configurations may be used.

The face cloth 32 may be the innermost layer of the garment, located inside the thermal barrier 30 and moisture barrier 28. The face cloth 32 can provide a comfortable surface for the wearer and protect the thermal barrier 30 and/or moisture barrier 28 from abrasion and wear. The face cloth 32 may be quilted to the adjacent layer (i.e. the thermal barrier 30 in the illustrated embodiment). However, the face cloth 32 is optional and may be excluded if desired. In addition, the garment may not necessarily include the moisture barrier 28 and/or the thermal barrier 30 in certain cases.

Each layer of the garment disclosed herein, including the layers and components described above, as well as those described below, and the garment as a whole, may meet the NFPA 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the outer shell 26, moisture barrier 28, thermal barrier 30 and face cloth 32 must be able to resist igniting, burning, melting, dripping, separation, and/or shrinking more than 10% in any direction after being exposed to a temperature of 500° F. for at least five minutes. Furthermore, in order to meet the NFPA standards, the combined layers of the garment must provide a thermal protective performance rating of at least thirty-five.

Alternately or in addition to the NFPA Standard 1971, the garment disclosed herein may also meet European Norm ("EN") standards for firefighting garments set by the European Committee for Standardization. These standards include EN 469:2005 Level 1 and Level 2 certification. The EN standards for firefighter and protective garments are entirely incorporated by reference herein.

Figure 2:
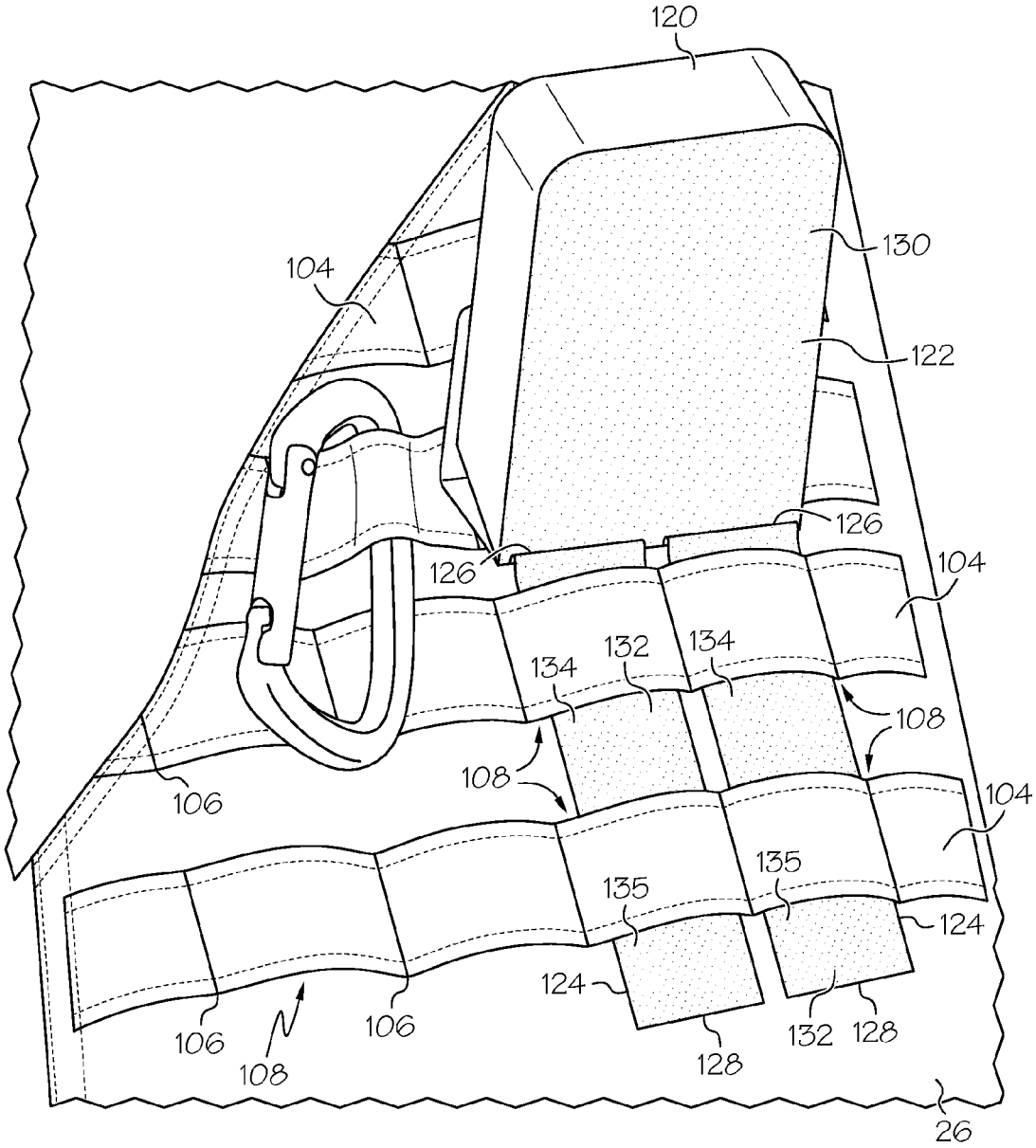
FIG. 2 is an enlarged, perspective view of a partially assembled view of a garment having a modular storage system.
Figure 3:
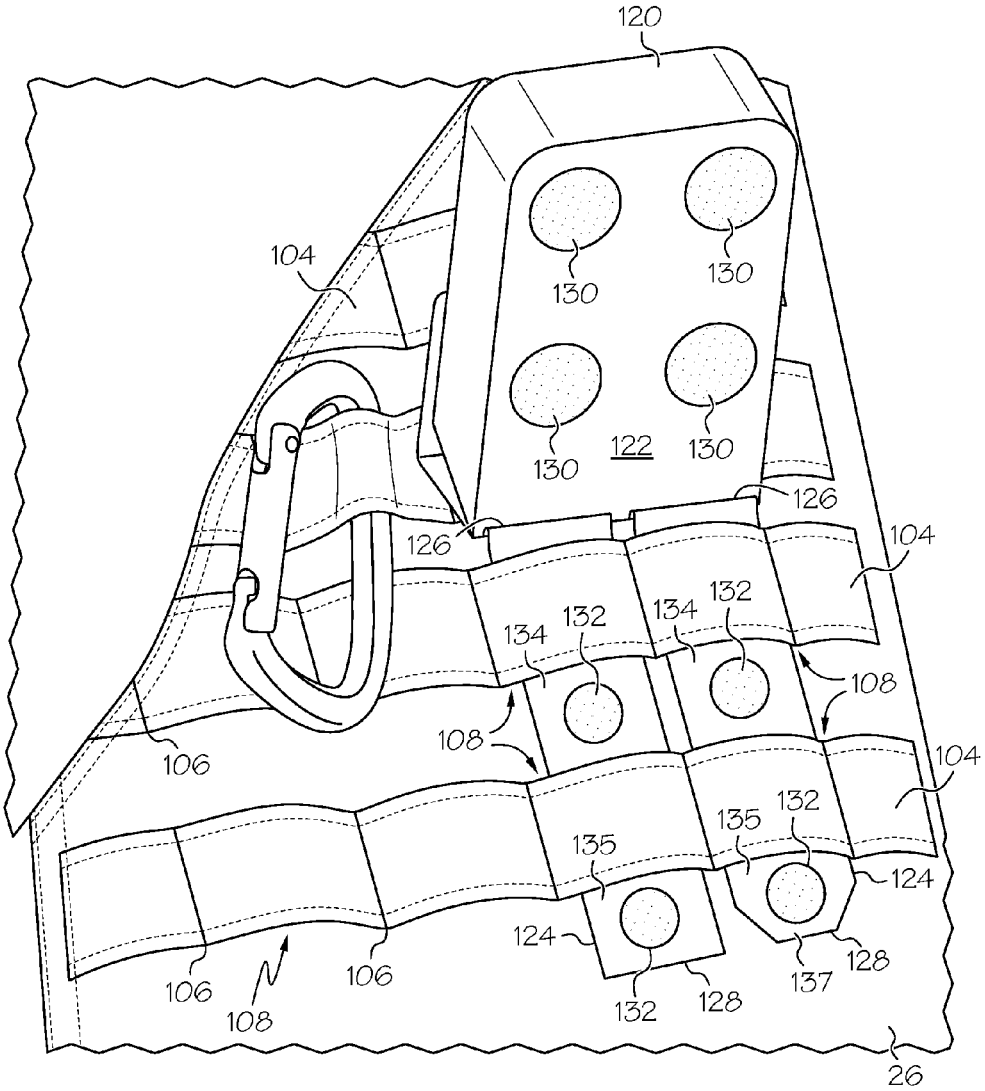
FIG. 3 is an enlarged, perspective view of a partially assembled view of a garment having another embodiment of the modular storage system.

As shown in FIGS. 2-4, the garments, coat 10 or trousers 50, may include a modular storage system 100 that includes one embodiment of a field of slits that may be formed by a plurality of spaced apart strips 104 that are each permanently fixed to a portion of an outer surface, such as outer shell 26, of the protective garment (FIGS. 1A, 2, 3, and left leg of FIG. 4) or to a panel of material 102 (FIG. 1B and right leg of FIG. 4) that is permanently or releasably coupled to the garment and includes a removable accessory 120 connectable to the spaced apart strips 104. The spaced apart strips 104 are permanently fixed to the garment 10, 50 or a panel of material 102 at spaced apart locations 106 along each strip 104 such that the spacing between locations is of sufficient distance to define openings 108 capable of receiving straps 124 of the accessory 120 therethrough (best seen in FIGS. 2 and 3).

The strips 104 are preferably fire resistant. The fire resistance may be provided by including or forming the strips with outer shell material or fire resistance webbing. While the figures illustrate two, three, four, or five strips oriented parallel to one another in a horizontal configuration relative to the donned orientation of the garment, there is no limit to the number of strips or the orientation of the strips. In another embodiment, the strips may be oriented vertically (not shown) or at an angle less than 90° relative to the donned orientation of the garment.

The accessory 120 has an exterior back surface 122 and at least one strap 124. The strap 124 has a fixed end 126 fixed to the accessory 120 and a free end 128 available for passage through the openings 108 in the strips 104. The exterior back surface 122 includes a first portion of a releasably attachable fastening system 130 and the strap 124 includes a second portion of the releasably attachable fastening system 132 on the side of the strap 124 that faces the exterior back surface 122 when the strap 124 is connected to the exterior back surface 122. In an assembled state, as shown in FIGS. 1A, 1B, and 4, the free end 128 of the strap 124 has passed through one opening 108, each, in at least two adjacent spaced apart strips 104, 104 and the second portion of the releasably attachable fastening system 132 is positioned on the strap 124 such that it is positioned on an exposed portion 134 between the two adjacent spaced apart strips 104, 104 and a second exposed portion 135 proximate the free end 128. The first portion of the releasably attachable fastening system 130 is positioned on the exterior back surface 122 such that it is mateable with the second portion of the releasably attachable fastening system 132 on the exposed portion 134 and free end 128 of the strap 124.

In one embodiment, as illustrated in FIG. 2, the entire exterior back surface 122 of the accessory 120 may be formed of or covered with the first portion of the releasably attachable fastening system 130 and the entire side of the strap 124 that faces the exterior back surface 122 is similarly formed of or covered with the second portion of the releasably attachable fastening system 132. In another embodiment, as illustrated in FIG. 3, the exterior back surface 122 of the accessory 120 may include a plurality of first portions 130 of the releasably attachable fastening system positioned for alignment with a plurality of second portions 132 on the straps 124. The second portions of the releasably attachable fastening system 132 are positioned on the strap to be on the exposed area 134 between adjacent strips 104, 104 and on the second exposed portion 135 proximate the free end 128 of the strap 124. While the portions of the releasably attached fastening system 130 and 132 are illustrated in FIG. 3 as circular patches, the shape and/or size is not limited thereto. These patches may be any shape and/or size that provide an appropriate amount of connection such that the accessory 120 is not susceptible to accidental removal during use by the wearer.

In one embodiment, the releasably attachable fastening system includes hook-and-loop material. The hook portion, the loop portion, or a combination thereof may be included on or may form the exterior back surface 122 of the accessory and the opposite configuration of hook portion, loop portion, or a combination thereof is included on or forms the strap 124 such that the exterior back surface 122 and the strap 124 are releasably attachable to one another. In another embodiment, the releasably attachable fastening system may be a plurality of snaps or other such fasteners.

As shown in FIGS. 2 and 3, the exterior back surface 122 of the accessory 120 does not include strips, loops, or openings for interlocking, interleaving, or weaving the straps 124 of the accessory back through or onto itself. On the contrary, the present modular storage system 100 is designed to feed the straps 124 of the accessory 120 directly through the openings 108 on adjacent strips 104.

The free end 128 of the strap 124 may be tapered gradually inward to form a generally pointed end 137 as illustrated for one of the straps 124 in FIG. 3. This configuration is advantageous because it makes threading the strap 124 through the openings 108 in the strips 104 easier. The generally pointed end 137 may also include a material such as a thermoplastic coating, attachment, or over-molded member (not shown) that makes it easier to thread the strap through the openings. The material may also add stiffness and gripability to the free end 128.

As depicted in FIGS. 1-4 the accessory 120 is a pocket. The pocket, generally designated 150 in FIG. 5, includes a front panel 151 opposite the back panel 122, two side panels 152, and a bottom panel 153 fixedly coupled together such that a pocket cavity 154 is formed therebetween. Both the front panel 151 and the back surface 122 may be generally flat, rectangular panels. The pocket 150 may be open or may include a closure flap 155 that can selectively cover the mouth 156 of the pocket cavity 154 when in its closed position. The closure flap 155 may be releasably attachable to the associated front panel 151, such as by one or more patches 157 of hook-and-loop fastening material located on the underside of the closure flap 155, and corresponding patch 158 of hook-and-loop fastening material located on the front surface of the front panel 151. Of course, any of a wide variety of other mechanisms may be used to cover the mouth 156 and generally retain the closure flap 155 in its closed position, including but not limited to slide fastener components, snaps, zippers, buttons, straps, ties, and the like. The pocket 150 also includes at least one strap 124 fixedly attached thereto. One end of the strap 124 may be fixedly connected to the upper portion of the back panel 122 proximate the mouth 156 or the closure flap 155 while the other end of the strap is a free end 128.

Figure 5:
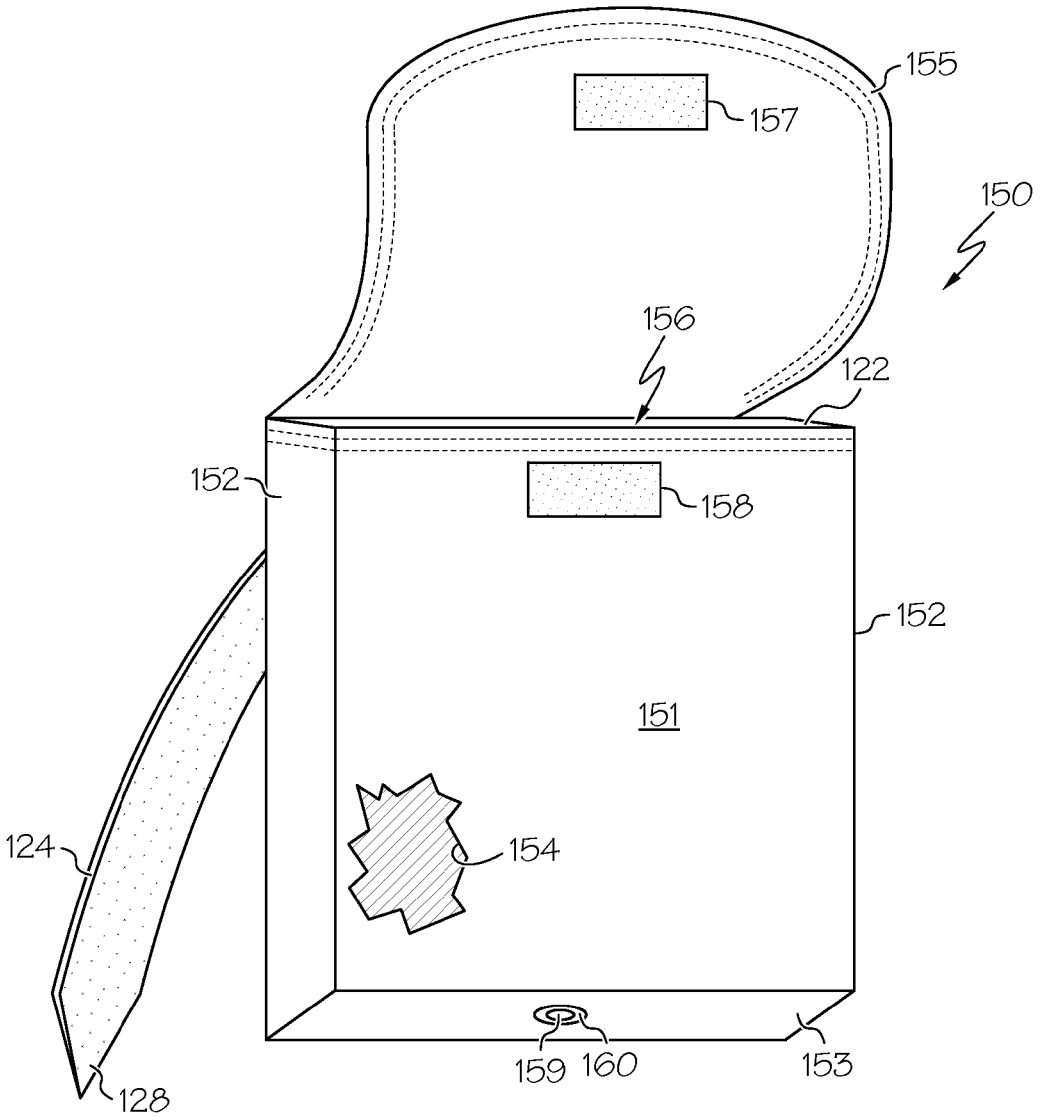
FIG. 5 is a front perspective view of a releasably attachable pocket.

Still referring to FIG. 5, the bottom panel 153 of the pocket 150 may include a drain hole 159 rimmed with a bracket 160 to allow water to flow out of and/or through the pocket. The pocket may include a gusset (not shown) in the side panels and/or the bottom panel to strengthen the pocket and/or allow for expansion of the pocket. The material of the pocket 150 (i.e. the front panel 151, back panel 122, side panels 152, bottom panel 153, and gussets (if present)) may be made of the same material, which may be the same as the outer shell 16, and the various panels may be stitched together to form the pocket. In one embodiment some of the various panels are integrally a one-piece material.

The accessory 120 is not limited to a pocket such as pocket 150. In other embodiments, the accessory 120 may be a pouch, a holster for example for a tool or flashlight, an identification holder, a rope holder or rope clip, or other equipment support feature that has a similar exterior back panel and strap configuration as described above for connection to a plurality of strips.

In one embodiment, as shown in FIG. 1A, the modular storage system also includes a fire resistant webbing 140 overlaying a portion of the spaced apart snips 104 and being oriented generally perpendicular to the strips 104. The fire resistant webbing 140 forms at least one opening or loop for attachment of a tool or other equipment of the wearer, for example a communication device such as a radio or waikie-talkie.

In another aspect, the modular storage system 100 includes a panel of fire resistant material 102 (FIGS. 1B and 4) having the plurality of spaced apart strips 104 each permanently fixed thereto and a removable accessory such as pocket 150 described above. The panel 102 may be removeably attachable to the wearer (rather than being integral with garment). The panel 102 is constructed as described above, but as illustrated in FIG. 4 also includes one or more first connectors 160 that attach the panel 102 to a belt 164 of a wearer and one or more second connectors 162 that attach the panel 102 to the leg of the wearer. The panel 102 may also include an adjuster 166 used to adjust the length of the connector 160 between the belt 164 and the top 103 of the panel 102.

The first connector 160 may be one or more straps that include a permanent loop or a loop formed by means of closing a releasably attachable member for receiving a belt, or an attachment member having a slot therein for receiving the belt. The releasably attachable member may be hook-and-loop material, snaps, hook and eye, magnets, or other similar members. The strap may include a buckle, clasp, snaps, generally D-shaped loops, magnetic clasps, or hook-and-loop releasably attachable members, but is not limited thereto, as or included in the adjuster 166.

The second connector 162 may include tie-able straps, a hook-and-loop releasably attachable strap, a belt having a buckle, clasp, snaps, generally D-shaped loops, or magnetic clasps, but is not limited thereto. The second connector 162 may include a plurality of straps that have stretch properties (are generally elastic or have elastic properties) while maintaining conformance to the performance and design requirements of NFPA 1971 or the other regulations disclosed herein.

Figure 6:
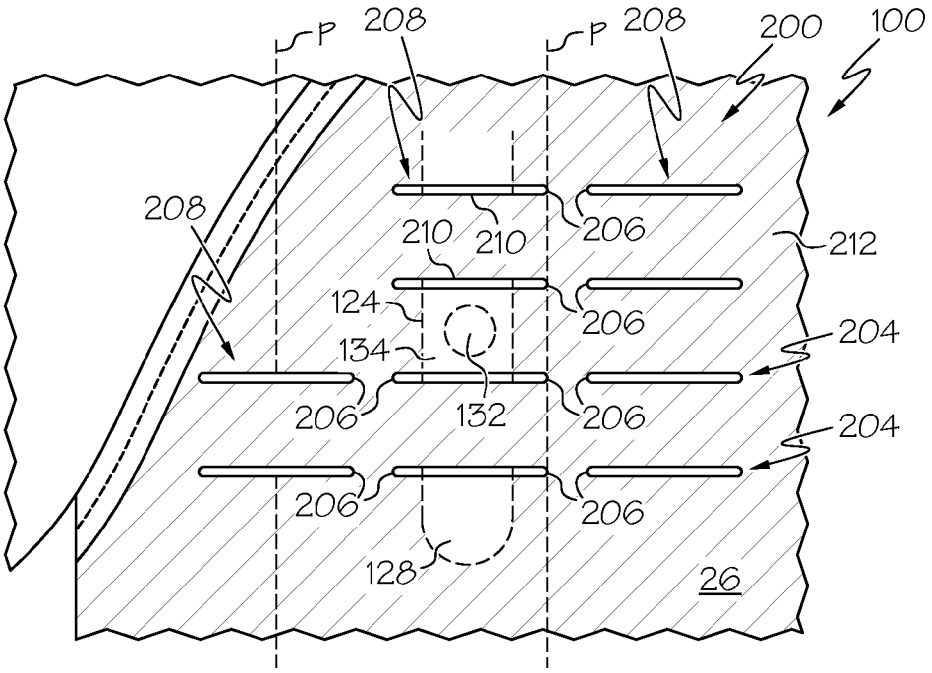
FIG. 6 is an enlarged, top plan view of a portion of a protective garment having another embodiment of a modular storage system.
Figure 7:
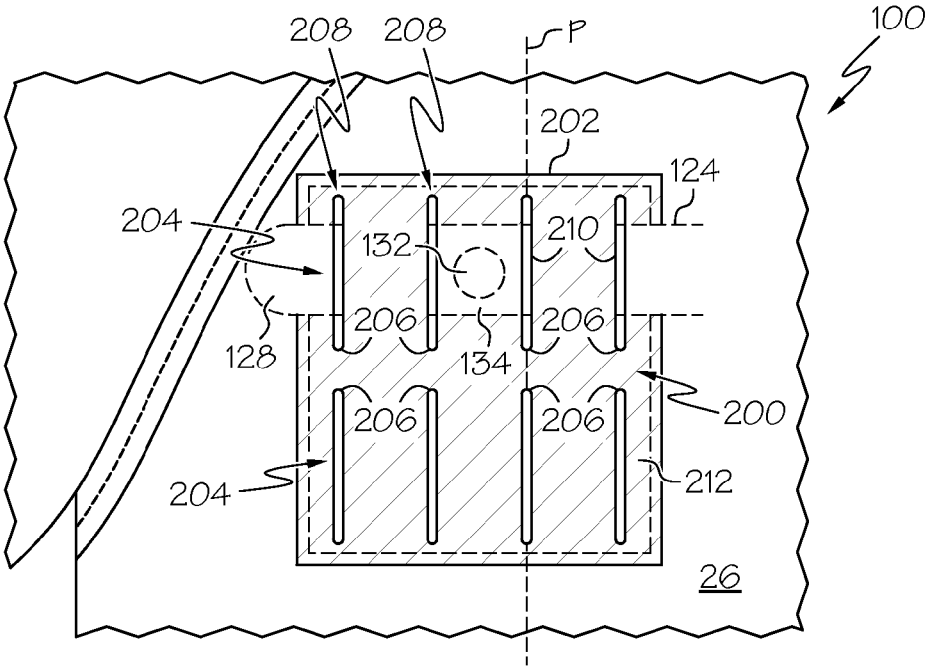
FIG. 7 is an enlarged, top plan view of a portion of a protective garment having another embodiment of a modular storage system at a different orientation than illustrated in FIG. 6.

In another embodiment, referring to FIGS. 6 and 7, the modular storage system 100 may comprise a field of slits 200 in the outermost layer or outer shell 26, 56 (FIG. 1A, FIG. 4) of the garment oriented to receive at least one strap 124 of an accessory. The portion of the outermost layer 26, 56 having the field of slits 200, whether formed directly in the outermost layer as shown in FIG. 6 or formed in a panel of material 202 fixed to the outermost layer as shown in FIG. 7, includes one or more of aramid fibers, polybenzamidazole fibers, and thermostable organic polymer material, such as NOMEX® and KEVLAR® fibers or KERMEL® fibers or fabric. The field of slits 200 includes a plurality of horizontally-oriented rows 204 each having one or more slits 206, wherein the one or more slits 206 among the horizontally-oriented rows are aligned to create one or more columns 208 each aligned with or centered on a different parasagittal plane P. In FIG. 6, the slits 206 within each column 208 are oriented with a longitudinal axis of each slit 206 generally transverse to the same parasagittal plane P. In FIG. 7, the slits 206 within each column 208 are oriented with a longitudinal axis of each slit 206 generally aligned with the same parasagittal plane P.

Still referring to FIGS. 6 and 7, in order to form the slits 206 in the outermost layer 26, 56 without fraying or unraveling of the fabric, the portion of the outermost layer 26, 56 having the slits 206 should include a coating 212 on one or both major surfaces thereof that includes a polymer such as, but not limited to, natural or synthetic rubber. In one embodiment, the polymer is or includes natural butyl rubber or synthetic butyl rubber. In another embodiment, the polymer is or includes chlorosulfonated polyethylene synthetic rubber. With the coating 212 in place the slits 206 may be formed directly in the outermost layer 26, 56 or the panel 202. In one embodiment, the slits 206 are die cut into the outermost layer 26, 56 or the panel 202. In another embodiment, the slits 206 are laser cut into the outermost layer 26, 56 or the panel 202.

Accordingly, the field of slits 202 may be made by providing a portion of material that includes one or more of aramid fibers, polybenzamidazole fibers, and thermostable organic polymer material, coating the portion of material with a polymer that prevents fraying or unraveling of the material; and thereafter forming, such as by cutting, a field of slits in the portion of material. The field of slits 202 includes a plurality of horizontally-oriented rows 204 each having one or more slits 206, which are further aligned with slits 206 in adjacent horizontally-oriented rows to create one or more columns 208 each aligned with or centered on a different parasagittal plane P. The coating cutting may be as described above.

The field of slits 200 are shaped and configured to receive one or more straps 124 of an accessory to be releasably attached to the garment. In FIG. 6, the free end 128 of the strap 124 has passed through at least two adjacent slits 210 in one column 208 and a second portion of the releasably attachable fastening system 132 is positioned on the strap 124 such that it is positioned on an exposed portion 134 of the strap protruding from the second of the two slits. In FIG. 7, the free end 128 of the strap 124 has passed through at least two adjacent slits 210 as the strap is fed through the slits 206 in a direct traverse to the parasagittal plane of each column 208 of slits 206 and a second portion of the releasably attachable fastening system 132 is positioned on the strap 124 such that it is positioned on an exposed portion 134 of the strap protruding from the second of the two slits.

Having described the invention in detail and by reference to the preferred embodiments, it will be apparent that modifications and variations thereof are possible without departing from the scope of the invention.

What is claimed:

1. A protective garment comprising:

a portion of material comprising a flame resistant material and a field of slits therein or thereon, the field of slits comprising a plurality of horizontally-oriented rows each having one or more slits, wherein the one or more slits among the horizontally-oriented rows are aligned to create one or more columns each generally aligned with or centered on a different parasagittal plane;

a removable accessory having an exterior back surface and at least one strap having a fixed end to the accessory and a free end, wherein the exterior back surface includes a first portion of a releasably attachable fastening system and the strap includes a second portion of the releasably attachable fastening system on the side of the strap that faces the exterior back surface when the strap is connected to the exterior back surface, and wherein the exterior back surface is free of features for weaving the strap back through and onto the removable accessory;

wherein, in an assembled state, the free end of the strap has passed through at least two adjacent slits and the second portion of the releasably attachable fastening system is positioned on the strap such that it is on an exposed portion of the strap protruding from the second of the two adjacent slits;

wherein the first portion of the releasably attachable fastening system is positioned on the exterior back surface of the removable accessory to mate with the exposed portion of the strap.

2. The protective garment of claim 1, wherein the portion of material is coated on one or both major surfaces thereof with a polymer that prevents fraying or unraveling of the material after formation of the slits therein.

3. The protective garment of claim 2, wherein the slits are cut into the portion of material.

4. The protective garment of claim 2, wherein the polymer includes natural or synthetic rubber.

5. The protective garment of claim 2, wherein the polymer includes a chlorosulfonated polyethylene synthetic rubber or a natural or synthetic butyl rubber.

6. The protective garment of claim 1, wherein the slits within each column are oriented with a longitudinal axis of each slit generally aligned with the same parasagittal plane or generally transverse to the same parasagittal plane.

7. The protective garment of claim 1, wherein the field of slits is formed on the portion of material as a plurality of spaced apart strips of flame resistant material or webbing permanently attached thereto at spaced apart locations along each strip such that the spacing between locations is of sufficient distance to define the slits for receiving the straps of the removable accessory.

8. The protective garment of claim 1, wherein at least one of the first and second portions of the releasably attachable fastening system is a hook portion and the other is a loop portion of hook-and-loop material.

9. The protective garment of claim 1, wherein the entire exterior back surface of the accessory is formed of or covered with the hook portion, the loop portion, or a combination thereof of a hook-and-loop material.

10. The protective garment of claim 9, wherein the entire side of the strap that faces the exterior back surface of the accessory is formed of or covered with the hook portion, the loop portion, or a combination thereof of a hook-and-loop material necessary to mate with the hook-and-loop material on the exterior back surface of the accessory.

11. The protective garment of claim 1, wherein the garment is fire resistant and meets National Fire Protection Association 1951, 1971, 1977, 1991, 1992, or 1993 or the European Norm standards for protective firefighting garments.

12. The protective garment of claim 1, wherein the garment resists igniting, burning, melting, dripping or separation when exposed to a temperature of 500° F. for five minutes.

13. The protective garment of claim 1, further comprising a moisture barrier of a material that is generally liquid impermeable and generally moisture vapor permeable; wherein, when the garment is worn, the moisture barrier is located between an outer shell that includes the field of slits and a wearer of the garment.

14. The protective garment of claim 1, further comprising a thermal liner having a thermal protection performance of at least about 20; wherein, when the garment is worn, the thermal liner is located between an outer shell that includes the field of slits and a wearer of the garment.

15. The protective garment of claim 1, further comprising a tire resistant webbing overlaying a portion of the field of slits, the fire resistant webbing being oriented generally perpendicular to the spaced apart strips and positioned proximal to the shoulder at a position to place a communication device within speaking range of the wearer.

16. The protective garment of claim 1, wherein the portion of material having the field of slits is a panel of fire resistant material fixedly coupled to the garment or is a panel of fire resistant material removably attachable to the wearer.

17. The protective garment of claim 16, wherein the panel is removably attachable to the wearer and further comprises a first connector capable of attaching the panel to a belt of the wearer and a second connector capable of attaching the panel to a portion of the wearer.

18. The protective garment of claim 17, further comprising at least one of a first adjuster to change the length of the first connector and a second adjuster to change the length of the second connector.

19. A method of making a modular storage system for a protective garment, the method comprising:

providing a portion of material comprising one or more of aramid fibers, polybenzamidazole fibers, and thermostable organic polymer material;

coating the portion of material with a polymer that prevents fraying or unraveling of the material;

cutting a field of slits in the portion of material, the field of slits comprising a plurality of horizontally-oriented rows each having one or more slits, wherein the one or more slits among the horizontally-oriented rows are aligned to create one or more columns each aligned with or centered on a different parasagittal plane; providing a removable accessory having an exterior back surface and at least one strap having a fixed end to the accessory and a free end, wherein the exterior back surface includes a first portion of a releasably attachable fastening system and the strap includes a second portion of the releasably attachable fastening system on the side of the strap that faces the exterior back surface when the strap is connected to the exterior back surface, and wherein the exterior back surface is free of features for weaving the strap back through and onto the removable accessory; and passing the free end of the strap through at least two adjacent slits and the second portion of the releasably attachable fastening system is positioned on the strap such that it is on an exposed portion of the strap protruding from the second of the two adjacent slits.

20. The method of claim 19, wherein the polymer includes natural or synthetic rubber.

21. The method of claim 19, wherein the slits within each column are oriented with a longitudinal axis of each slit generally aligned with the same parasagittal plane or generally transverse to the same parasagittal plane.

* * * * *

UNITED STATES PATENT AND TRADEMARK OFFICE

CERTIFICATE OF CORRECTION

PATENT NO. : 8,973,169 B2
APPLICATION NO. : 13/767941
DATED : March 10, 2015
INVENTOR(S) : Curtis et al.

It is certified that error appears in the above-identified patent and that said Letters Patent is hereby corrected as shown below:

In the Claims

Col. 11, Claim 15, Line 2, delete

"a tire resistant webbing overlaying a portion"

insert

-- a fire resistant webbing overlaying a portion --

Signed and Sealed this
Thirtieth Day of June, 2015

Michelle K. Lee

Michelle K. Lee
*Director of the United States Patent and Trademark Office*